United States Patent [19]

Loibl

[11] 4,121,652

[45] Oct. 24, 1978

[54] APPARATUS FOR SEPARATING A STARTER BAR HAVING A STARTER BAR HEAD FROM A HOT STRAND CROP-END IN A CONTINUOUS CASTING PLANT

[75] Inventor: Lorenz Loibl, Baden, Austria

[73] Assignee: Vereinigte Österreichische Eisen-und Stahlwerke - Alpine Montan Aktiengesellschaft, Linz, Austria

[21] Appl. No.: 770,099

[22] Filed: Feb. 18, 1977

[30] Foreign Application Priority Data

Feb. 26, 1976 [AT] Austria ..... 1416/76

[51] Int. Cl.$^2$ ..... B22D 11/08

[52] U.S. Cl. ..... 164/446; 164/426

[58] Field of Search ..... 164/274, 82, 425, 426, 164/445, 446

[56] References Cited

U.S. PATENT DOCUMENTS 3,464,482 9/1969 Greenberger ..... 164/274

3,971,429 7/1976 Horeth ..... 164/274 X

FOREIGN PATENT DOCUMENTS 1,302,875 1/1971 Fed. Rep. of Germany ..... 164/274

*Primary Examiner*—Francis S. Husar

*Assistant Examiner*—John S. Brown

*Attorney, Agent, or Firm*—Brumbaugh, Graves, Donohue & Raymond

[57] ABSTRACT

An apparatus for separating a starter bar from a hot strand crop-end in a continuous casting plant (which plant includes a lifting mechanism for lifting the starter bar and its tong-shaped starter bar head, a stationary vertical guide, and an opening mechanism for the two lockable nippers of the tong-shaped starter bar head) has a centering means in the stationary vertical guide to hold the starter bar in separating position, at least one bayonet closing means locking the nippers of the tong-shaped starter bar head, a displaceable pin acting on the at least one bayonet closing means in the opening direction thereof, and a conveying means located below the centering means and the displaceable pin for transporting the hot strand crop-end away.

6 Claims, 10 Drawing Figures

FIG. 8
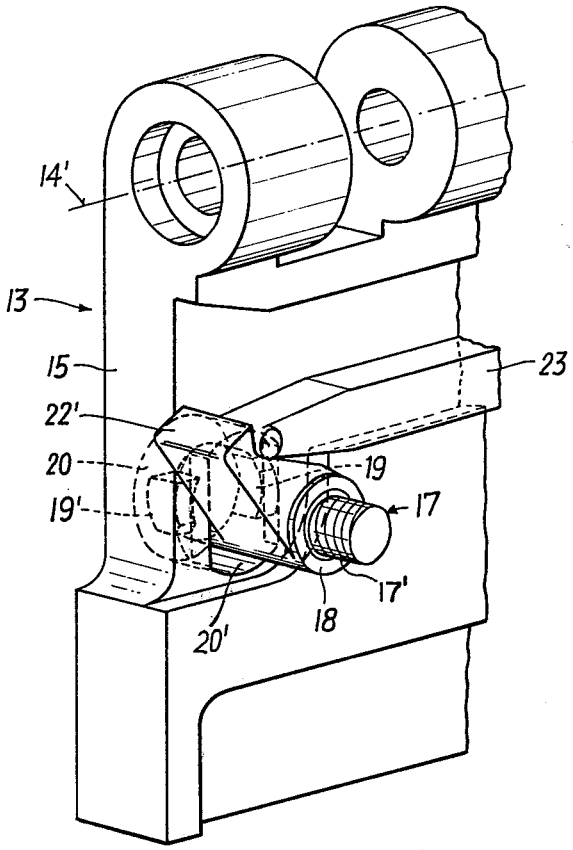
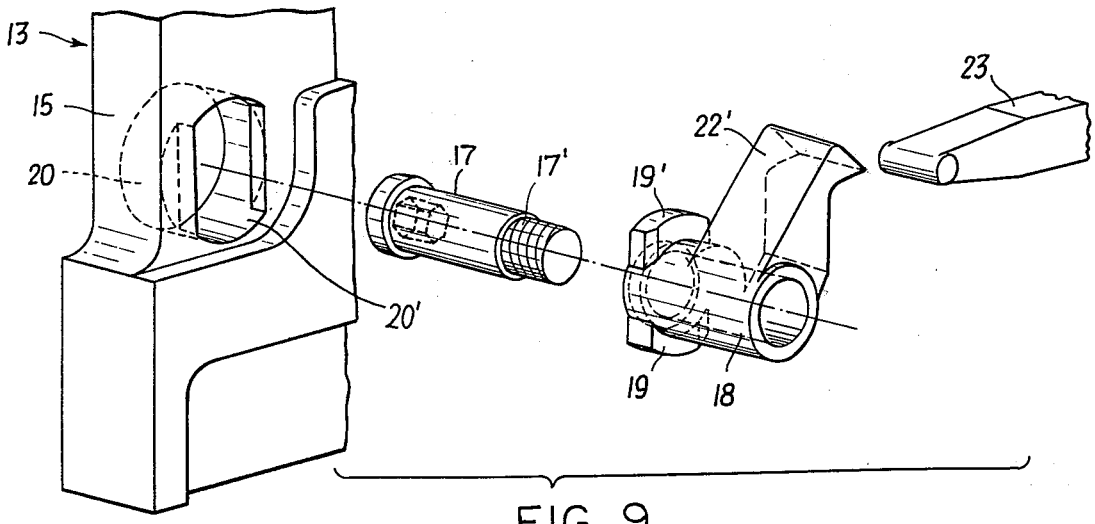
FIG. 9

APPARATUS FOR SEPARATING A STARTER BAR HAVING A STARTER BAR HEAD FROM A HOT STRAND CROP-END IN A CONTINUOUS CASTING PLANT

BACKGROUND OF THE INVENTION

The invention relates to an apparatus for separating a starter bar from a hot strand in a continuous casting plant in which the starter bar is lifted by a lifting mechanism (such as a cable pull or chain hoist), in a vertical stationary guide, wherein the starter bar head is tong-shaped and the nippers of the tongs are lockable and can be opened by an opening mechanism.

The connection between a tong-shaped starter bar head and the hot strand can be effected with the help of a rail-shaped connection piece or by allowing the bit of the tongs be filled with solidified molten metal during casting. The separation of the nippers of the tongs, which are locked during the extraction, from the hot strand can either be effected by a forced opening mechanism in which the nippers of the tongs are opened via guide rails, or by cutting off the crop end with a torch cutting machine. In most cases, the crop end then is separated from the starter bar head outside of the machine, which requires manipulation by hand and additional personnel.

SUMMARY OF THE INVENTION

The invention aims at avoiding these difficulties and has as its object the separation of the crop end from the starter bar within the circulatory system in which the starter bar is moved through the continuous casting plant, i.e. the circulatory system formed by the strand guide, the torch cutting roller path and a vertical stationary guide extending to the level of the transporting roller path, which vertical guide leads back to the introduction position in the strand guide. Also the extraction of the hot strand must not be impeded, facility downtimes are to be avoided and additional personnel are to be rendered unnecessary.

According to the invention, this object is achieved in that a centering means is provided in the vertical guide for holding the starter bar in its separation position, that the nippers of the tongs are kept in a closed position by a bayonet closing means and can be opened by a displaceable pin acting in the opening direction upon the bayonet closing means in the centering position, and that below the centering and separating means a conveying means is provided for moving away the crop end of the hot strand.

According to a preferred embodiment, the bayonet closing means comprises a bolt secured in one nipper of the tongs and a rotatable sleeve surrounding the bolt. The sleeve has claws that can be rotated into a recess in the other nipper of the tongs and the displaceable pin co-acts with a lever-like projection connected to the sleeve to rotate the claws out of the recess and into an opening position.

The pin in addition may be provided with a conical lengthening part for urging the nippers of the tongs apart.

Advantageously, the conveying means is designed as chute.

For connecting the starter bar head with the hot strand, a plurality of bayonet closing means comprised of bolts and sleeves can be provided, and the lever-like projections of the rotatable sleeves can be articulately inter-connected by rod means.

Advantageously, the centering means is designed as a set of tongs that can be hydraulically actuated, which tongs are secured at the lower part of the vertical guide.

BRIEF DESCRIPTION OF THE DRAWINGS

An embodiment of the invention shall now be described in more detail by way of example only and with reference to the accompanying drawings, wherein:

FIG. 8 is an enlarged view of the bayonet connection, FIG. 9 is an exploded view of the bayonet connections.

DESCRIPTION OF AN EXEMPLARY EMBODIMENT

Figure 1:
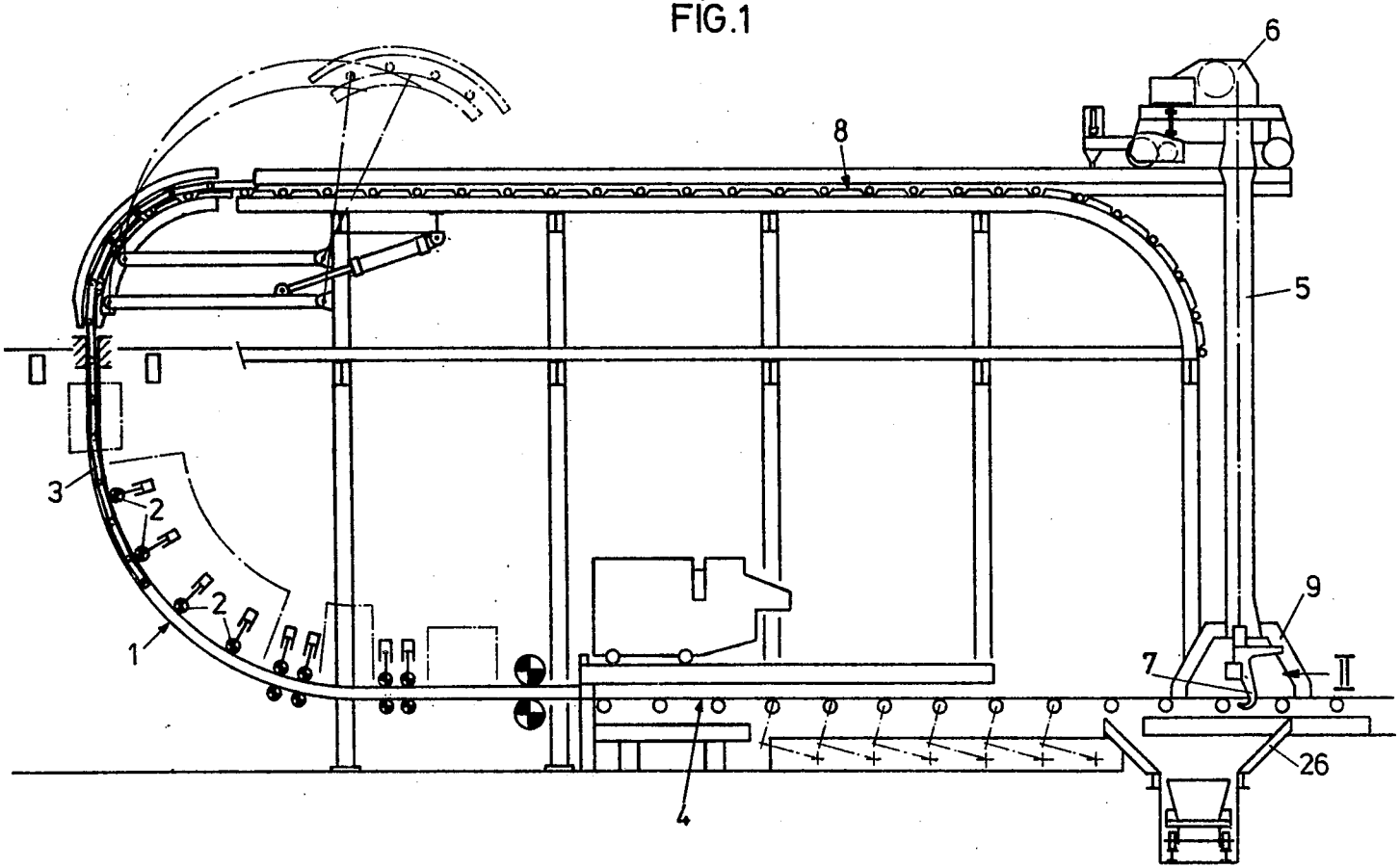
FIG. 1 is an overall view of the continuous casting plant, schematically illustrated.
Figure 2:
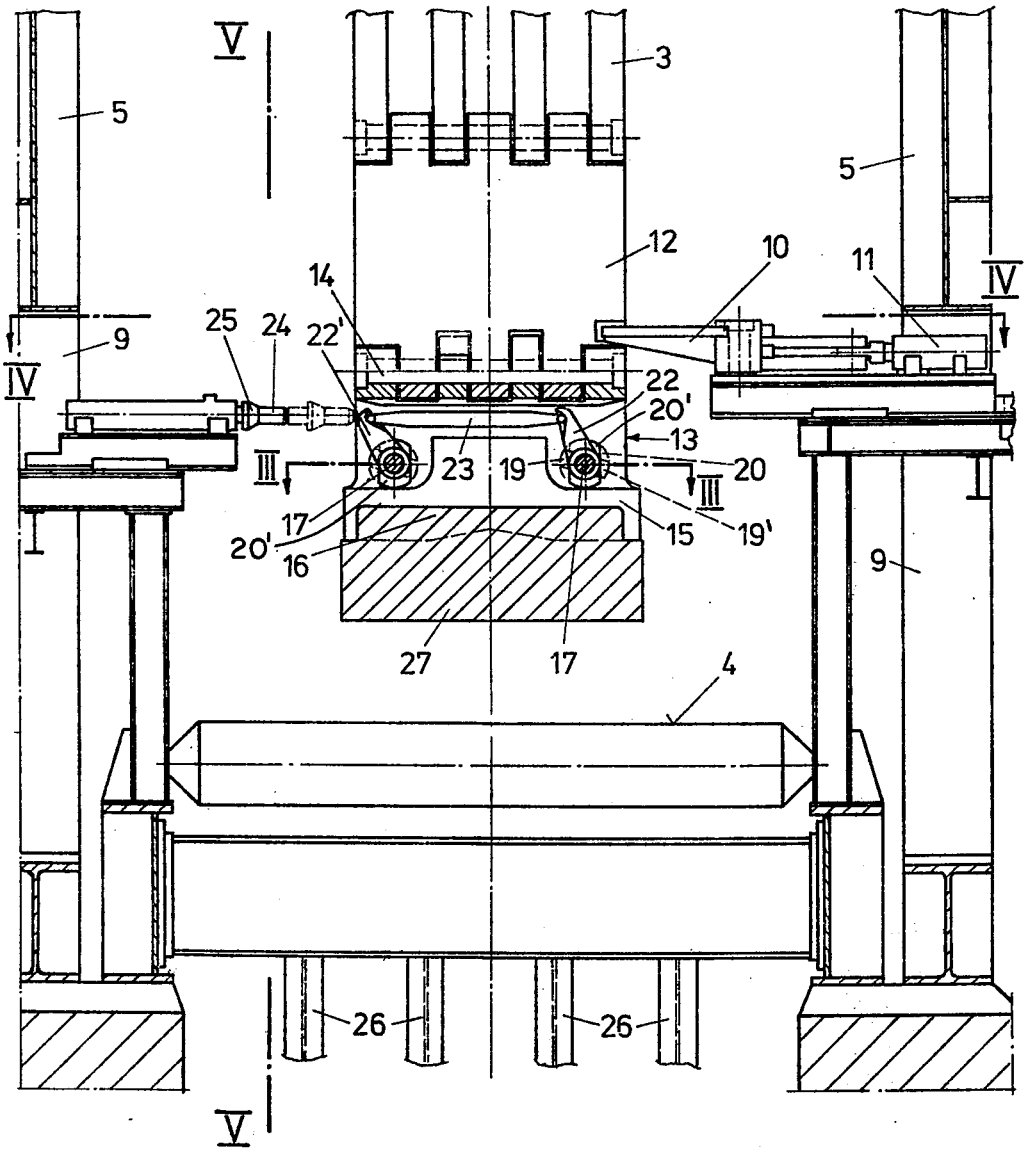
FIG. 2 shows a view on an enlarged scale and in the direction of the arrow II of FIG. 1 with a lifted starter bar in section.
Figure 5:
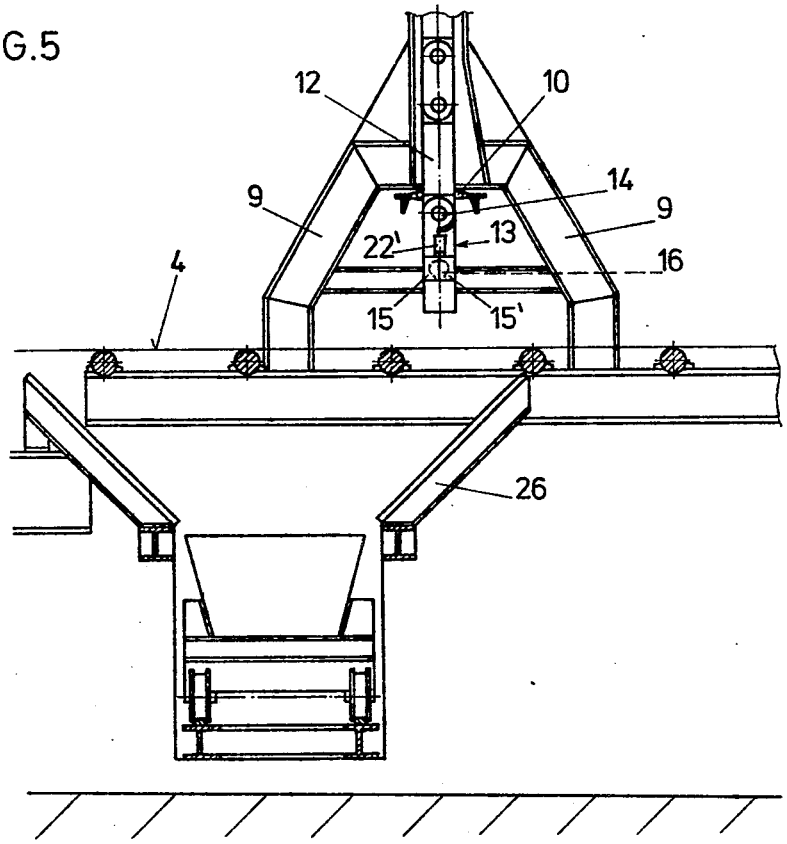
FIG. 5 is a section along line V—V of FIG. 2.
Figure 4:
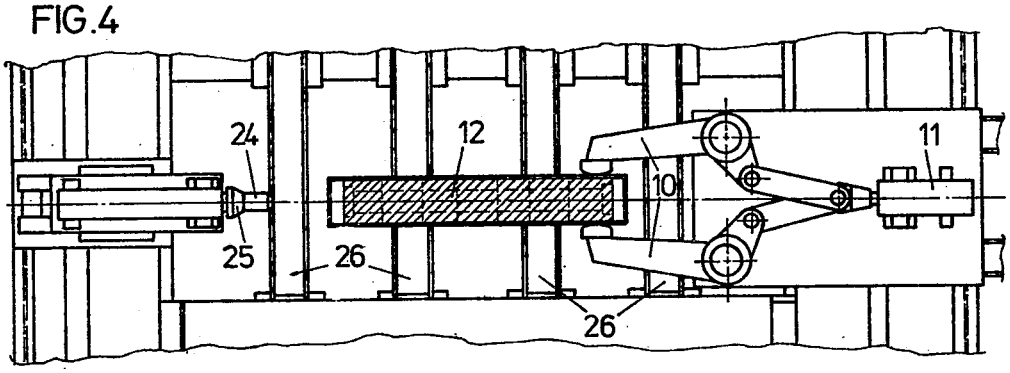
FIG. 4 is a section along line IV—IV of FIG. 2.
Figure 3:
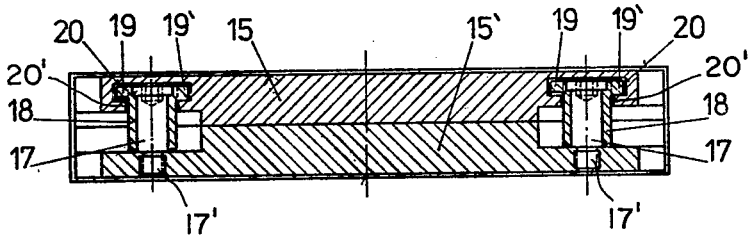
FIG. 3 is a section along line III—III of FIG. 2.
Figure 10:
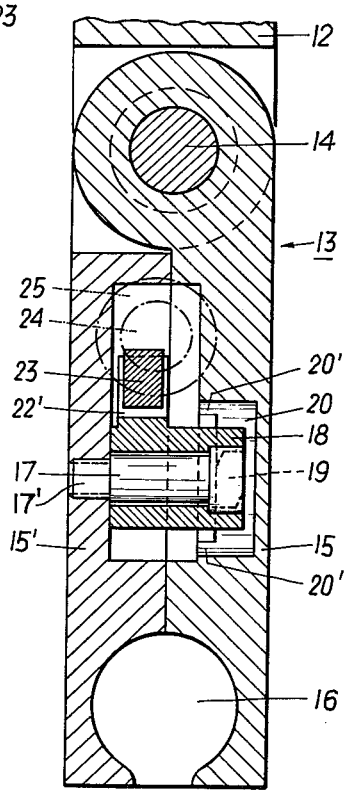
FIG. 10 is an enlarged cross section of the starter bar head in FIG. 5 showing its connection to the strand.

In the overall view according to FIG. 1, a strand guide is provided with driven rollers 2 for gripping a flexible starter bar 3 comprised of articulately connected members. By 4 a horizontal torch cutting and run out roller table is denoted, on which table the starter bar and the hot strand are conveyed out of the strand guide. By 5 a stationary vertical guide is denoted, in which guide a lifting mechanism 6, e.g. a chain hoist or a cable pull, with a receiving hook 7 is guided. Somewhat above the casting platform, a roller path 8 is provided, by which path the starter bar lifted by the lifting mechanism can be brought into position for introduction into strand guide 1 again. When passing the torch cutting roller table, the crop or section of the strand in contact with the starter bar is cut off the rest of the hot strand. As soon as the foot end of the starter bar has reached the vertical guide and when the hook 7 has snapped into it, the starter bar is lifted until the starter bar head and the crop end attached to it have arrived in the structure part 9 of the vertical guide and freely hang above the run out roller table. To this structure part a horizontal pair of tongs 10 is secured (FIG. 2), which tongs can be actuated by a hydraulic cylinder 11. As can be seen from FIG. 4, the nippers of this pair of tongs grip the starter bar, i.e. the first member 12 of the starter bar following the starter bar head. The pair of tongs 10 holds the starter bar tightly in this position and centers it so that the crop end is prevented from swinging. The starter bar head 13 is also designed tong-shaped and comprises two tong-nippers 15 and 15' rotatable about the bolt 14, as can be seen from FIG. 5 and FIG. 10. The mouth of the tongs embraces a rail-shaped connection piece 16 attached to the strand or is filled with molten metal in the mould at the onset of casting, which metal solidifies to form the connection.

Figure 6:
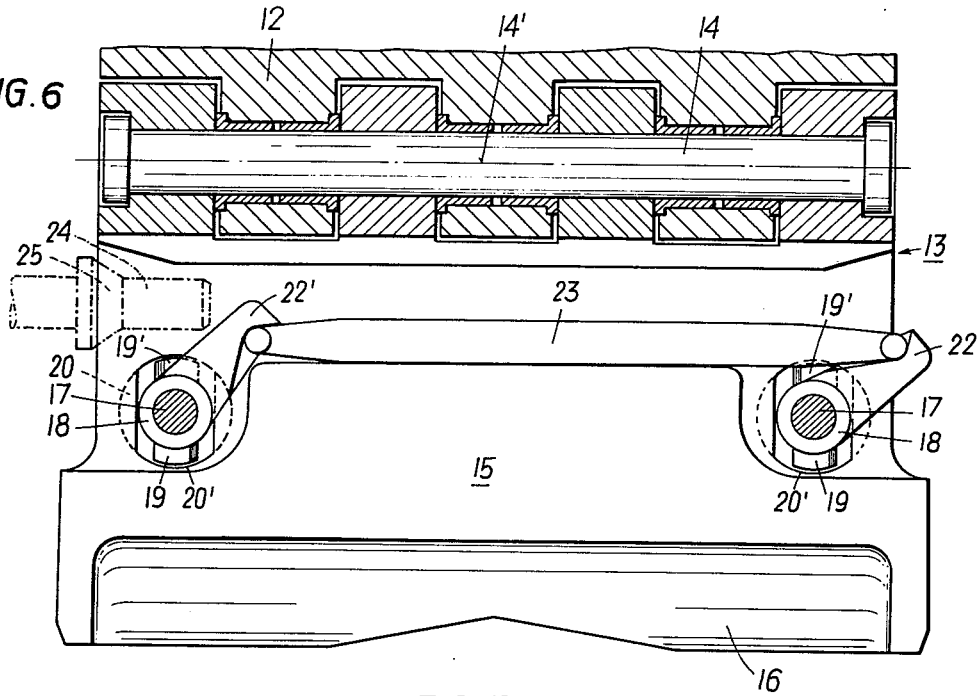
FIG. 6 is an enlarged view of the starter bar head of FIG. 2.
Figure 7:
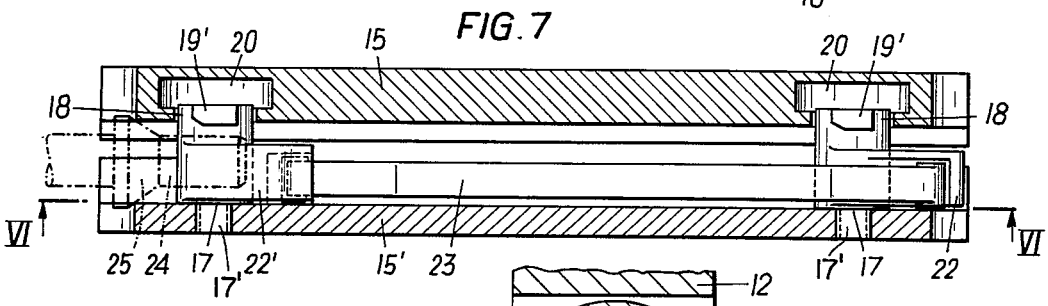
FIG. 7 is a view similar to FIG. 3, but showing the details of the bayonet closing means.

As can be seen from FIG. 3 and 7–10, the nippers (15 and 15') of the starter bar tongs are locked by a bayonet-like closing means, wherein the closing means comprises a plurality — two in the example illustrated — of bolts 17 which are fixedly connected with the one tong-nipper 15' by threads 17'. Each bolt is surrounded by a rotatable, axially undisplaceable sleeve 18 having lateral claws 19 and 19'. The claws extend into a recess 20 in the other tong-nipper 15, which recess 20 is in contact with an elongated bore 20' in nipper 15 which receives the sleeve 18. As best seen in FIG. 8, when the claws are not aligned with the elongated slot 20' they hold nipper 15 on sleeve 18; but, when they are aligned, nipper 15 can move free of sleeve 18 and nipper 15' (FIGS. 6 and 9). The sleeves are provided with lever-like projections 22 and 22', and the projections are articulately interconnected by a connecting rod 23. On the structure part 9, on the side opposite the tongs 10, a movable pin 24 is secured. This pin advantageously can be hydraulically actuated, so onto be moved into the position illustrated in FIG. 2 in broken lines, where its front end abuts the projection 22' and moves it together with the other projections into the opening direction via the rod means 23. This causes the claws (19 and 19') of sleeves 18 to rotate out of the recesses 20 and to be aligned with the longer dimension of the elongated bores 20' so that they no longer form a connection between nipper 15 and sleeves 18, and the nippers are free to separate. The downward force due to the weight of the crop-end should cause the nippers to open once the claws no longer hold them together. The pin 24 carries a conical lengthening part 25 which urges the nippers of the tongs apart if they jam. Because of its weight the freed crop end 27 falls upon the conveyor chute illustrated in FIG. 1 and denoted by 26, and from there it is transported off.

Thus the separation of the crop end from the starter bar is possible in an easy manner and without additional personnel.

I claim:

1. In apparatus for separating a starter bar having a starter bar head from a hot strand crop-end in a continuous casting plant of the type including a lifting mechanism, such as a chain hoist or a cable pull, a stationary vertical guide and an opening mechanism for releasing the starter bar head from the crop-end, the starter bar head having two lockable nippers to give it a tong-shaped configuration and being liftable by said lifting mechanism in said stationary vertical guide, the opening mechanism opening the two lockable nippers of the starter bar head, the improvement comprising:

a centering means in the stationary vertical guide for holding the starter bar in a separating position, at least one bayonet closing means for locking the two lockable nippers of the starter bar head, a displaceable pin acting on the at least one bayonet closing means in the opening direction when the starter bar is in the separating position for opening the at least one bayonet closing means, and a conveying means arranged below the centering means and the displaceable pin for transporting off the hot strand crop-end.

2. An apparatus as set forth in claim 1, wherein the at least one bayonet closing means comprises:

a bolt fastened in one of the two lockable nippers of the starter bar head, a sleeve rotatably secured on the bolt and being adapted to pass through an elongated bore in the other one of the two lockable nippers of the starter bar head, which bore communicates with a recess in the other nipper, the rotatable sleeve having claws adapted to pass through said bore when in an opening position and to extend into and backup said recess when in a closing position, a lever-like projection connected with said sleeve, the displaceable pin co-acting with said lever-like projection to open said bayonet closing means.

3. An apparatus as set forth in claim 1, wherein the displaceable pin has a conical lengthening part for urging apart the two lockable nippers of the starter bar head.

4. An apparatus as set forth in claim 1, wherein the conveying means is designed as chute.

5. An apparatus as set forth in claim 2, with a plurality of bayonet closing means, further comprising rod means articulately inter-connecting the lever-like projections.

6. An apparatus as set forth in claim 1, wherein the centering means is designed as a pair of tongs adapted to be hydraulically actuated and fastened to the stationary vertical guide at the lower part thereof.

* * * * *